US007287456B2

(12) United States Patent
Spielberger

(10) Patent No.: US 7,287,456 B2
(45) Date of Patent: Oct. 30, 2007

(54) BREECH-BLOCK SYSTEM FOR A FIREARM

(76) Inventor: Peter Spielberger, Auhirschenweg 36, Vienna (AT)

( * ) Notice: Subject to any disclaimer, the term of this patent is extended or adjusted under 35 U.S.C. 154(b) by 0 days.

(21) Appl. No.: 11/189,283

(22) Filed: Jul. 26, 2005

(65) Prior Publication Data

US 2007/0012170 A1 Jan. 18, 2007

(51) Int. Cl.
*F41A 3/64* (2006.01)
*F41A 3/82* (2006.01)

(52) U.S. Cl. ..... 89/196; 89/180; 42/14

(58) Field of Classification Search ..... 89/196, 89/180, 14.3, 160–162, 183–185; 42/14, 42/16–18, 39.5, 69.02, 75.02, 75.03
See application file for complete search history.

(56) References Cited

U.S. PATENT DOCUMENTS

| | | | | | |
|---|---|---|---|---|---|
| 956,431 | A * | 4/1910 | Schmeisser | ..... | 89/144 |
| 1,138,376 | A * | 5/1915 | Hammond | ..... | 89/185 |
| 1,840,054 | A * | 1/1932 | Reising | ..... | 89/196 |
| 2,535,156 | A * | 12/1950 | Pastore et al. | ..... | 89/196 |
| 3,755,948 | A * | 9/1973 | Heinicke | ..... | 42/17 |
| 4,579,037 | A * | 4/1986 | Gillum | ..... | 89/180 |
| 4,760,663 | A * | 8/1988 | Zedrosser | ..... | 42/15 |
| 5,325,617 | A * | 7/1994 | Vojta et al. | ..... | 42/75.03 |
| 6,761,102 | B2 * | 7/2004 | Giza | ..... | 89/194 |
| 6,993,864 | B1 * | 2/2006 | O'Clair et al. | ..... | 42/75.02 |

* cited by examiner

*Primary Examiner*—Bret Hayes
(74) *Attorney, Agent, or Firm*—Charles C. Logan, II

(57) ABSTRACT

A breech system for a firearm exhibits a breech which can be locked in its movement in the barrel block by at least one locking element, which is pressed against the rear end of the barrel by means of a breech spring surrounding the rigid barrel of the weapon, the barrel being enclosed with the exception of the front and rear apertures, whereby the breech spring is supported at the rear section of the barrel and at least one link element subjected to tension connects the front end of the breech spring and the breech. In order to guarantee precise function and in a manner which is safe for the user, by means of a simple arrangement which is reproducible in manufacture, a purely mechanical delay element is inserted in the link between the breech (10) and the breech spring (9).

8 Claims, 4 Drawing Sheets

BREECH-BLOCK SYSTEM FOR A FIREARM

BACKGROUND OF THE INVENTION

The invention relates to a breech system for a firearm, with a breech capable of being locked in its movement in the barrel block by means of at least one locking element, which is brought into contact against the rear end of the barrel by means of a breech spring, whereby the breech spring is supported at the rear section of the barrel by at least one connection element, subjected to tension.

A distinction is made between the following types of the breech system for automatic and semi-automatic pistols, rifles, machine pistols, and carbines:

The pure mass breech, i.e. the relatively small mass of the projectile round is opposed by a correspondingly high mass of the breech (the breech must not have moved any further before the round has left the barrel than the length of the cartridge case, or the delayed mass breech, i.e. in addition to the interplay of the masses, a rigid or semi-rigid breech is used, which restrains the movement of the breech until the round has left the barrel, and, with regard to the gas pressure, until pressure relief has been established in the barrel.

The first version is characterized by the corresponding simplicity and reliability, but because of the high loading stress involved can only be used for small projectile rounds, e.g. 9 mm Luger. For larger calibers, e.g. 45 Auto (0.45 inch Automatic Colt Pistol), a very powerful breech spring would be required, which would render manual loading or repeating almost impossible unless the spring travel were very long, which in turn leads to corresponding size and weight, as shown by the example of the MP38 machine pistol, caliber 9 mm Luger, of German design from the Second World War.

The second version requires corresponding additional structural and technical effort, whereby with long-barreled weapons the delay is usually achieved by means of tapping the gas pressure in the barrel. By means of one or more hole(s) in the barrel the gas pressure is diverted to a number of breech elements; once the round has left the barrel, the gas pressure drops off and the breech elements clear the breech (DtG 58, StG 77 and many others). In isolated cases handguns are also encountered which make use of this principle (Steyr GP). The main disadvantage lies in the gas holes themselves, since if they become blocked this can lead in the simplest situation to malfunction, and in the worst case to the user being injured.

The most widely encountered version in the case of handguns is the Browning System, where the barrel is prevented by a system of slots and grooves in its movement rearwards until the round has left the barrel. When the round has left the barrel, the force which holds the barrel in its position drops off (created by the fact that the round is actually somewhat larger than the diameter of the barrel), and the barrel moves to the rear by itself and tilts downwards. The disadvantage with this arrangement is the moving barrel, with which it cannot be guaranteed that it will be in exactly the same position again after each shot (in relation to the sight, which is secured to the retractor or slide). A further disadvantage is the relatively high mass of the moving parts (480 g for the Colt M1911), from which the user acquires the subjective feel of the recoil and which makes the rapid repetition of aimed shots one after another difficult or even technically impossible (cadence).

In AT 393 028 B a self-loading pistol is described which is provided with a rigid barrel even for larger calibers (45 Auto). Originally designed as a gas-pressure loader for assault weapons, the system was converted for self-loading pistols, whereby, among other features, torus segments are used as semi-rigid locking elements. These torus segments engage on the outside in corresponding torus nest mounts of the system part, and on their inside are prevented by a round control piston from releasing the locking mechanism too rapidly. This system is intended to function in accordance with the principle of the "Newtonian balance", whereby the pulse resulting from the energy of the explosion, which is disseminated equally in all directions, impinges on the locked breech part, but this immediately passes its energy onto the control piston in the interior of the breech piece, which moves rapidly to the rear and so releases the torus segments. The proper function, or the malfunction equally, depends solely on the manufacturing tolerances interacting by chance in their totality in such a way that the torus segments are not fully locked but exhibit a slight degree of play, which must, however, not be sufficiently great as to damage the segments. A total of the smallest parts would therefore have to be capable of being produced in such a form that the total of the tolerances with double and triple passes is just great enough for the breech piece to begin to move, but small enough for the torus segments not to be over stressed, which, incurred due to the design, at one point in time are located at only one point inside and one point outside, and are subjected over a line to flexural and shear stress.

DE 31 09 730 discloses a weapon with a breech which can be locked in its movement in the barrel block by at least one locking element, which is pressed against the rear end of the barrel by a locking spring, via at least one connection element subjected to tension. The barrel itself is movable, however, so that, because of the play induced by manufacturing technology, it can never be ensured that the barrel, after the discharge, will be in exactly the same position as it was before. With a movable barrel, however, the locking spring must be located at a distance, which increases the space requirement and makes the weapon more unwieldy. In addition t to this, the opposing lines of force which are exerted by the gas pressure of the round in the barrel on the breech and the closure force of the locking spring, cause a disturbance in the weapon, which is likewise very detrimental to the precision of the shot.

The weapon which is described in DE 29 14 396 likewise has a breech which can be locked in its movement in the barrel block by means of at least one locking element, which is forced against the rear end of the barrel by a locking spring by means of at least one connecting element subjected to tension. The barrel itself is likewise again movable, with the disadvantages referred to heretofore of the play incurred by manufacturing technology, with impairment of shooting precision. Again, therefore, the lines of effect of the forces which are exerted by the gas pressure of the round in the barrel onto the breech and the closure force of the locking spring are opposed to one another, which is likewise detrimental to shooting precision. The weapon also does not exhibit any supporting bolt breech as a mechanical delay, but a pure rolling breech, while a type of support bolt alone serves to support the barrel to the front. This therefore forms only a limitation on the movement of the barrel in its initial position before the shot is discharged.

SUMMARY OF THE INVENTION

The object of the present invention was therefore to provide a breech system of the type described in the preamble, which is provided by a simple arrangement capable of reproducible manufacture, which guarantees a reliable and precise function, even with rapid repeated firing, and in a safe manner for the user.

To achieve this object, according to the main feature the invention makes provision for the barrel to be immovable and for the locking spring to be supported at the rear section of the barrel, and a purely mechanical delay is introduced solely between the breech and the locking spring.

Any delay in the release occurs quite on its own by geometrically implementable mechanical processes in accordance with the principle of oblique planes with components which are straightforward with regard to process engineering, whereby malfunctions due to blockages can be reliably avoided. As a result of this, and in combination with the rigid barrel, the system is not sensitive with regard to the caliber and charge of the ammunition used. These features provide the user with a very safe and reliable weapon with low recoil and low barrel lift incurred as a result of the design.

According to an advantageous embodiment of the invention, the mechanical delay is incurred by a delay spring, a support bolt, and a delay block, whereby the support bolt is supported in a support block nest mount of the breech block, the rear face of which, with the front face of the delay block, forms a V-shaped mounting open towards the barrel, and whereby the delay block is moved towards the barrel by the delay spring supported at the breech.

To advantage, provision is also made in this context for the delay spring to be supported on an impact plate on the rear of the breech, which, when the breech is closed, is located at a short distance from the delay block.

In order to guarantee an adequate delay of the movement of the actual breech until the round has left the barrel, a further advantageous feature of the system according to the invention lies in the fact that the distance between the impact plate and the breech and delay block respectively, which defines the spring travel of the delay spring, is small in comparison with the length of the delay spring.

To achieve a design which is symmetrical around the barrel in terms of forces, provision is made according to a further feature of the invention for two trapezoidal carriages as lateral drawing elements to be provided for as the link between the breech and the breech spring, located on mutually opposing sides of the barrel.

If, in addition, provision is made in the longitudinal position of the barrel and of the breech at the level of the position of the cartridge in at least one trapezoidal carriage, and for preference in both trapezoidal carriages, for cut-outs in the cartridge ejector, then cartridge case ejection is possible on both sides, so that the weapon can be easily and rapidly adjusted for both right-handed and left-handed users, and allows for use by both groups without the ejected empty cartridge cases being thrown in front of or into the face of the user.

A further contribution is provided by the additional feature that two mutually opposing mounts for the ejector are provided at the breech.

If, according to an advantageous feature of a further embodiment of the invention, the trapezoidal carriages engage with their end located opposite the breech in a spring guide sleeve which represents the second tensioning of the breech spring, which is located at a distance interval on all sides from the barrel of the weapon, in the same manner as the breech spring, the barrel can oscillate freely (as with a sniper's rifle), since it is only screwed into the barrel block in the area of the cartridge location, and no other part touches the barrel. It is entirely irrelevant in this case whether the system is incorporated in a self-loading pistol, a precision rifle, or an assault rifle.

The design according to the invention in general allows in a simple manner for a modular construction design, whereby, for example for a possible change of caliber, only the barrel, the modular ramp, the ejector, the extractor hook, and the delay spring need to be changed. With all other known systems, either the entire upper part of the pistol must be replaced, and in most cases even the upper part and the breech part.

The solution according to the invention exhibits a rigid, mechanically very stiff upper part, which does not alter its position in relation to the barrel, which to advantage can be used as an integrated mounting rail for a telescopic sight. In this situation, the barrel is screwed into the barrel block, which serves simultaneously as the mounting rail for a telescopic sight, so that no deviation at all occurs between the barrel and the telescopic sight or is constant, and therefore easy to take into account. The possibility also pertains of the complete integration of a telescopic sight (without mounting rail), since the barrel block does not move when the shot is fired. As a replacement for rear sight and front sight, a telescopic sight, possibly with the corresponding optical enlargement, could be incorporated directly into the barrel block, which, by means of fibre optics (during daylight) and tritium for poor lighting conditions, serves as an optical sight. In addition to this, a battle illumination device or a laser can be incorporated into the barrel cover (where the breech spring is located with modern pistols).

As a further consequence the solution according to the invention also provides the basis for the structure of a self-loading pistol without a hammer, in which no part moves to the rear above the user's hand, by contrast with the pistols conventionally used today, with which the entire upper part (carriage) moves to the rear, which not infrequently leads to injuries to the user's hand.

DESCRIPTION OF THE DRAWINGS

The invention is explained in greater detail hereinafter by reference to the appended drawings.

DESCRIPTION OF THE PREFERRED EMBODIMENT

Figure 1:
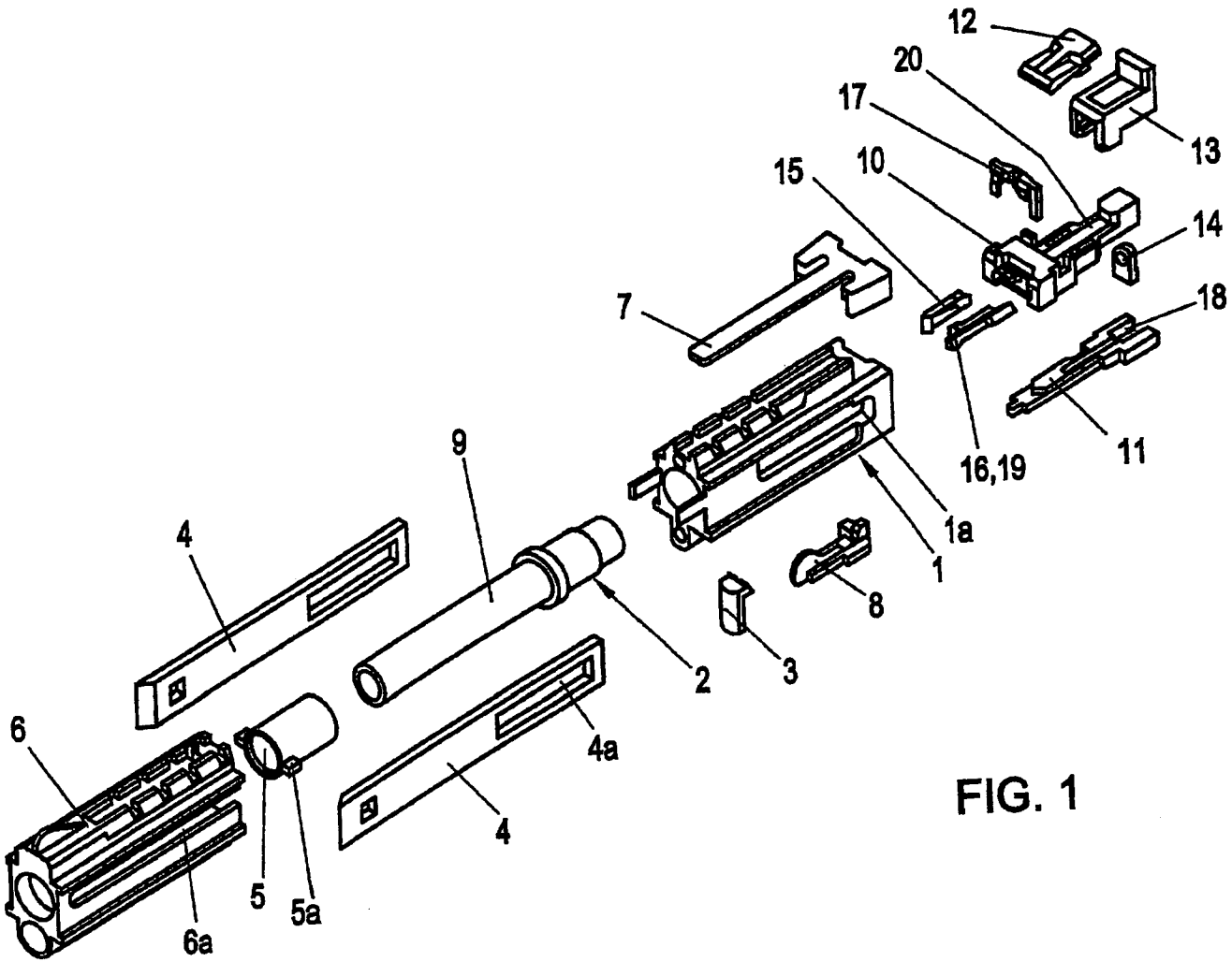
FIG. 1 shows all of the components of the system according to the invention in an exploded representation.
Figure 2:
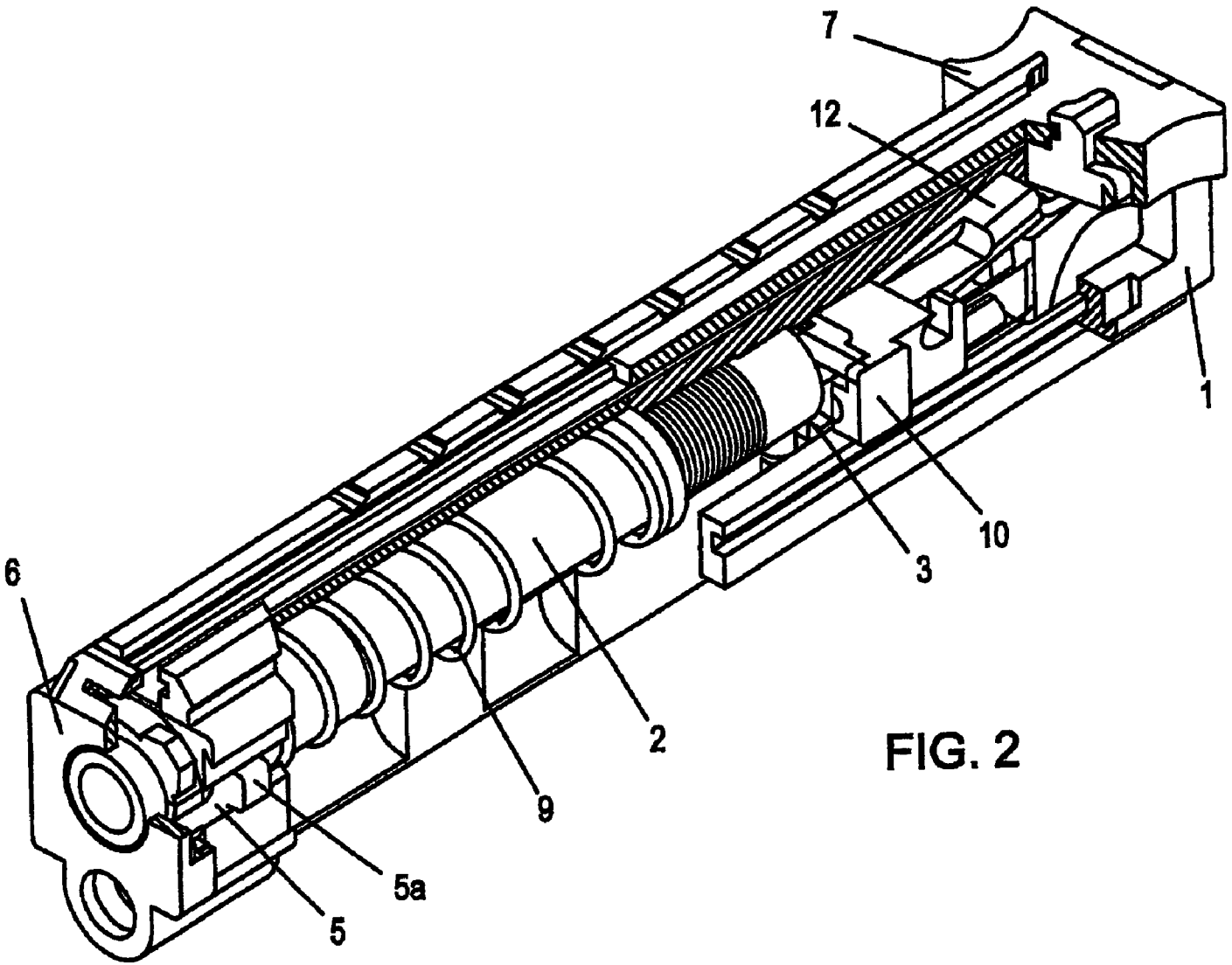
FIG. 2 is a perspective view of the system according to the invention in the assembled state.

The central part of the system is the barrel block 1, into which the barrel 2 is screwed, and is therefore only fixed at this screw insertion point. As a result, high shot precision is guaranteed, since a rigid unit is formed from the barrel block 1 which also allows for the optimum mounting or integration of a sight, and from the rigid barrel 2, without other moving parts, or parts which change their position relative to one another while the shot is discharged. It is further of advantage that convenient manufacturing tolerances can be used for all moving parts. A ramp 3 is also inserted as a separate component between the barrel 2 and the barrel block 1. By means of this replaceable ramp, which can be selected in accordance with the ammunition used, the cartridge is introduced into the cartridge chamber of the rigid barrel 2. This ramp 3 is a critical part with all self-loading weapons systems, and is usually a part of the barrel. Different shapes of projectile rounds, however, also require different ramp shapes for perfect feed, as a result of which the replaceable ramp 3 of the design according to the invention is a clear advantage, since different ramps 3 can be used for the most widely differing shapes of rounds.

The link between the breech 10 and the barrel 2 is formed by means of two lateral trapezoidal carriages 4, extending along and parallel to the barrel 2, of which the front ends are suspended in lateral projections 5*a* of a spring guide sleeve 5. These lateral projections 5*a* of the spring guide sleeve 5 are guided in longitudinal slots 6*a* of a front barrel cover 6, but which, exactly like the spring guide sleeve 5 itself, does not actually touch the barrel 2. In the area of the barrel block 1, in addition, a tensioning slide 7 and a carriage catch lever 8 are incorporated in the area of the barrel block 1, and, due to the breech spring 9, which likewise surrounds the barrel 2 without touching it, the breech 10 is moved in the direction towards the rear end of the barrel 2 with the breech closure force.

The breech 10 is provided with an action or standing face 11, and is held in the locked position by means of a support bolt 12 by means of the fact that this support bolt 12 is supported against the barrel block (as explained in greater detail hereinafter). The support bolt interacts in the unlocked position with the moving delay block 13, the backwards movement of which is dampened by the delay spring 18, and is delimited by the impact plate 14 of the breech 10. Likewise linked to the breech 10 are inherently-known components such as the extractor claw 15 for the cartridge case, the ejector 16, and the ejector spring 19 and cartridge holder 17. In order in this situation to allow for the cartridge cases to be ejected optionally on both sides, longitudinal cut-outs 4*a* are provided in both trapezoidal carriages 4, and likewise lateral longitudinal holes 1*a* in the barrel block 1, as well as cut-outs on both sides of the longitudinal axis in the breech 10, into which, alternately, the extractor claw 15 and the ejector 16 can be inserted. In order to guarantee that, when the breech 10 is closed, the support bolt 12 will reliably travel back into its locked position opposite the barrel block 1, support block springs 20 are provided which move the support bolt 12 towards this position.

Figure 3:
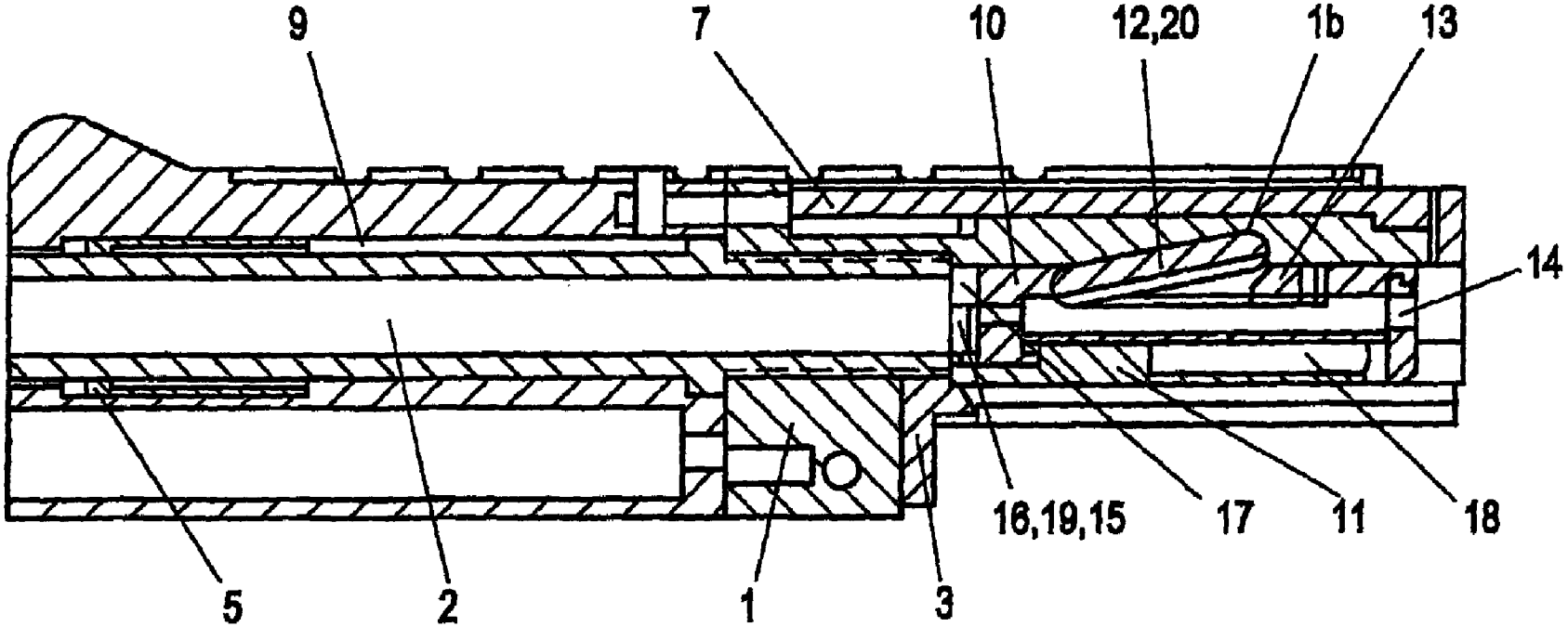
FIG. 3 is a longitudinal section through the breech system according to the invention in the locked state.
Figure 4:
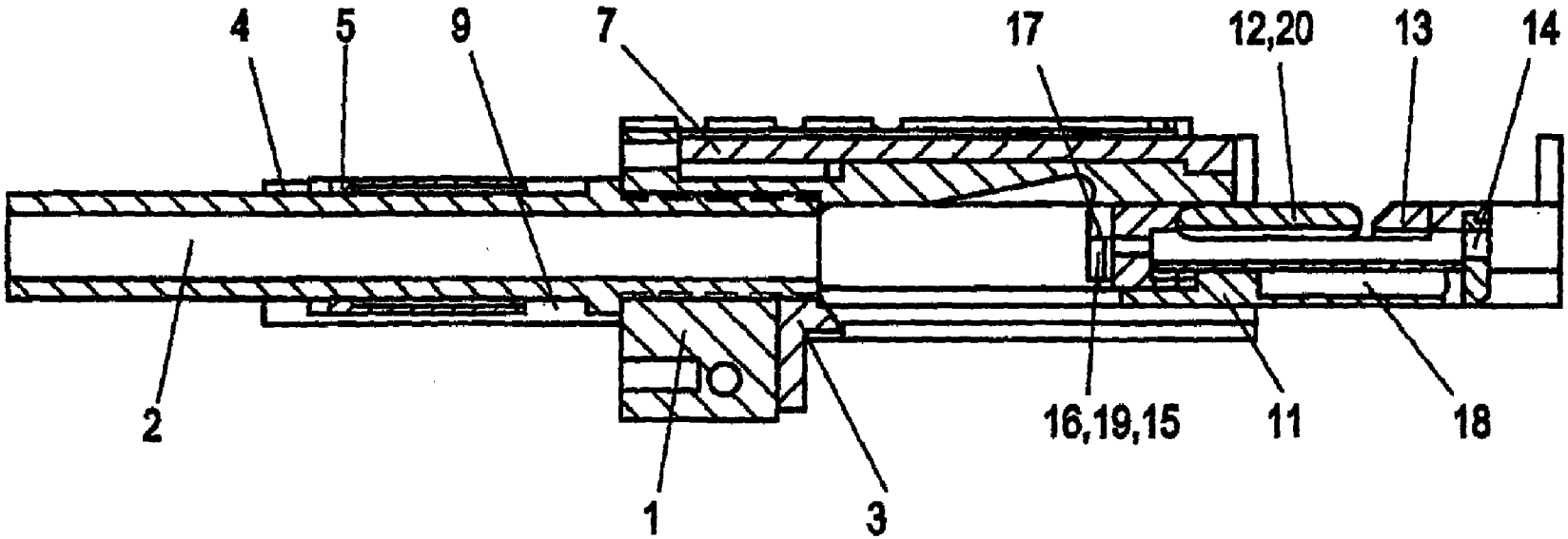
FIG. 4 shows a longitudinal section corresponding to FIG. 3, but in the unlocked state with the breech moved to the rear.

The means of function of the breech system according to the invention when a shot is fired are explained hereinafter by way of reference to FIG. 3 and FIG. 4. The explosion pulse impacts onto the front side of the breech 10 which is turned towards the barrel 2. This, however, is held in position by the support bolt 12, which is supported in the support bolt nest mount 1*b* of the barrel block 1. The force which is deflected by the support bolt 12 mainly into the barrel block 1 is conducted on the one hand via the end of the support bolt 12 onto a n oblique plane of the support bolt nest mount 1*b* and, simultaneously, reduced accordingly by the geometry of the support bolt 12, is also conducted onto the oblique plane of the delay block 13. This force pushes the support bolt 12 along the oblique planes referred to towards the breech 10, and initially accelerates the delay block 13, which slides sufficiently far to the rear that the support bolt 12 can tilt downwards, possibly even against the force of the support bolt spring(s) 20, and is released in its entirety from the support bolt nest mount 1*b* of the barrel block 1. In this position of the support bolt 12, the breech 10 is then cleared, and can in turn carry out the opening movement towards the rear.

The delay block 13 is in turn delayed in its movement to the rear by the corresponding spring force, by means of the action or standing face 11, which in turn slides in a groove of the breech 10 and which contains the delay spring 18, which is supported on the impact plate 14. This delay must be sufficient for the round to have left the rigid barrel 2 at its front end before the actual movement of opening the breech 10 begins. This can be easily be guaranteed by an appropriately designed delay spring 18, the spring travel path of which amounts to only a few millimeters, but the length of which amounts to several centimeters.

Only after this process has been completed does the breech 10 begin to move to the rear against the force of the breech spring 9. The breech 10 draws the trapezoidal carriages 4 arranged on both sides, which in turn are connected to the spring guide sleeve 5 and at which the breech spring 9 is supported, which in turn is supported with its other end at the barrel block 1. Neither the breech spring 9 nor the spring guide sleeve 5 touch the barrel 2 on its surface, as a result of which it can oscillate freely. Due to the use of at least two trapezoidal carriages 4 in a symmetrical arrangement, there is no tilting and/or jamming of the breech whatsoever. The spring guide sleeve 5 is guided on its outside by the barrel cover 6, which for preference is connected to the barrel block by means of screw bolts, and is centered at the barrel 2 by means of a collar, guided for preference by the lateral projections 5*a* in longitudinal slots 6*a* of the barrel cover 6. The diameter of the breech spring 9, which is large in comparison with other pistols, makes it possible for this to be designed highly elastically and independently of the caliber and charge of the ammunition.

The breech 10 now moves to the rear against the force of the breech spring 9, together with the components spring guide sleeve 5, trapezoidal carriages 4, extractor claw 15, ejector 16, cartridge holder 17, support bolt 12, folded in and lying parallel to the breech 10, delay block 13 in its rearmost position, impact plate 14, compressed delay spring 18, action or standing face 11 in its rearmost position, as well as firing pin and firing pin spring (not shown). This involves a straight movement to the rear, without any tilting (by contrast with the tilting breech according to the Browning System) or twisting (by contrast with the known rotary action system).

The cartridge case is held by the cartridge holder 17, the ejector 16, and the extractor claw 15, and drawn out of the cartridge chamber of the rigid barrel 2. As soon as this rearwards movement has progressed to the point at which a full cartridge, not yet fired, would have space to be ejected through the windows 4*a* of the trapezoidal carriages 4, the ejector 16 located in the breech 10 strikes with its rear end on the rear end of the window frame of the window 1*a* in the barrel block 1, and moves forwards against the direction of movement of the breech 10 and against the spring force of the ejector spring 19, the other end of which is supported at the cartridge holder 17. The cartridge case is held by the extractor claw 15 at the point opposite the ejector 16 on the circumference of the cartridge head, and is accordingly ejected through the other window 1*a* of the barrel block 1 and the cut-out 4*a* of the trapezoidal carriage 4.

To eject the cartridge case in the other direction, i.e. the opposed cut-outs 4*a* and 1*a* respectively, only the ejector 16 and the extractor claw 15 in the breech 10 need to be replaced.

The force of the ejector spring 19 now takes effect together with the force of the already compressed breech spring 9, and accordingly guarantees a comparatively gentle impact of the breech 10 at the rear ends of the window frames of the barrel block 1. The low mass of all the moving parts and the interplay of the two springs, paired with the entirely straight-line movement, accordingly provides the weapon with a very "gentle" shooting behavior.

When the last cartridge case has been ejected from the magazine, the carriage catch lever 8 can for preference be pushed upwards by the magazine spring and engage in a corresponding cut-out on the underside of the trapezoidal carriage 4, and so interrupt the repetition process; i.e. the breech 10, together with its ancillary components, remains in the rearmost position and a new, full magazine can be introduced, and the interrupted repetition process can be continued by the carriage catch lever 8 being held down manually.

In order to prevent any asymmetric force effect, a carriage catch lever 8 can be provided for on both sides and connected by an axle. If the ejection side is changed, the carriage catch lever 8 would nevertheless be required on the "other" side.

The breech 10, together with all its ancillary components, now begins to move forwards again due to the force of the compressed breech spring 9. The front end of the action or standing face 11 in this situation impacts (between the lips of the magazine) onto the upper end of the cartridge head, and so pushes the next cartridge ahead of it, out of the magazine. By means of the ramp 3, which to advantage is replaceable, the cartridge is introduced into the cartridge chamber of the rigid barrel 2. This ramp 3 could also, in the usual manner, be an integral part of the barrel 2. Different projectile round shapes, however, also require different ramp shapes for perfect feed, so that a separate, replaceable ramp 3 is a clear advantage in the sense of maximum flexibility and the adaptation capability of the weapon.

The ejector 16, due to the force of the compressed ejector spring 19, draws back into its initial position in the breech 10. As soon as the breech 10 has moved sufficiently far forwards that the support bolt 12 can again lock into the support bolt nest mount 1*b* in the barrel block 1, the support bolt 12, for preference supported by the support bolt spring(s) 20, but in any event by the oblique plane of the delay block 13, likewise sliding forwards, begins to be locked. Simultaneously, the action or standing face 11 now again moves forwards, due to the force of the compressed delay spring 18, beneath the cartridge already located in the cartridge chamber. The cartridge is now centered in relation to its position with regard to the breech 10 from four sides, from above by the cartridge holder 17, to the right and left by the extractor hook 17 and the ejector 16, designed for preference as spring-loaded components, and downwards by the now projecting part of the action or standing face 11. This guarantees that the firing pin will also strike the center of the cartridge, where the percussion cap is located.

Provision can be made on the action or standing face 11, for preference on its underside, for one or more cut-out(s), which are intended in the first instance to deactivate one or more safety devices on the receiver or handle (lower part of the weapon, not shown) in order to prevent a premature and/or unintentional discharge of the weapon. The weapon is now ready to fire again, the cartridge in the barrel and the safety devices off.

In the case of manual repetition (discharging), the following sequence takes place: By drawing the cocking handle 7 to the rear, which is guided in a slot in the barrel block 1, and which is in contact with its rear end at the delay block 13, the delay block 13 is moved to the rear with the action or standing face 11 against the force of the delay spring 18. The safety devices which engage in the action or standing face 11 are immediately activated, in order to prevent any unintentional discharge of the weapon, even before the support bolt 12 is disengaged from the support bolt nest mounting 1*b* in the barrel block 1, because the support bolt 12 is still held in the locked state by the support bolt spring(s) 20.

Because this procedure takes effect directly on the delay block 13 and mot, as when firing, over the oblique edge of the block, this can be easily put into effect manually, and does not require any major expenditure of force, which is normally required with weapons of greater caliber (45 Auto and larger). The breech spring 9, in comparison with weapons of current design, is designed as soft and elastic, since the mass of the moving parts of the system according to the invention constitute only about 50% of the mass of conventional weapons (240 g as opposed to the 480 g mass of the moving parts of the Colt Government M1911). From this point on, the procedure is the same as that described above.

If the cocking handle 7 is, as usual, released in the rearmost position, then, because it is in fact in contact with the delay block 13, it will be pushed back again into its initial position. During the discharge of the shot, the cocking handle 7 does not move.

The locking surfaces are dimensioned to be as large as possible, and, because of the force relationships, the barrel block 1 can be manufactured of the lightest possible materials, for example of duraluminium. The cocking handle 7 and the barrel cover 6 can also be made of lightweight materials, such as also of duraluminium, aluminum, or even plastic.

The invention claimed is:

1. A breech system for a firearm, comprising:

(a) a rigid barrel having a front section and a rear section and a front aperture and a rear aperture;

(b) a barrel block having a front face and a rear face, a breech spring, a delay spring, a support bolt and a delay block having a front face and a rear face;

(c) at least one locking element and at least one link element; and (d) a support bolt supported by a support bolt nest mount located on said barrel block;

whereby said at least one locking element, is pressed against said rear section of said rigid barrel by said breech spring surrounding said rigid barrel, said breech spring being supported at said rear section of said rigid barrel; and whereby said at least one link element is subjected to tension and thereby connecting said front end of said breech spring and the breech, creating mechanical delay between said at least one link element between the breech and said breech spring; and the breech system further including said mechanical delay comprising said delay spring said support bolt, and said delay block, whereby said support bolt supported in said support bolt nest mount of said barrel block, wherein said rear face of said barrel block together with said front face of said delay block creates a V-shaped mounting open towards said rigid barrel, and further whereby said delay block is moved towards said rigid barrel by said delay spring supported at the breech.

2. The breech system for a firearm according to claim 1, further comprising an impact plate wherein said the delay spring is supported by said impact plate and further wherein said impact plate is located on the rear face of the breech.

3. The breeeh system for a firearm according to claim 2, wherein the distance interval between said impact plate and the breech respectively, and said delay block, defines the spring travel of said delay spring (18), and further wherein this distance interval is proportionally less than the total length of said delay spring.

4. The breech system for a firearm according to claim 1, further comprising two trapezoidal carriages acting as said at least one link element, located between the breech and said breech spring, and used as lateral drawing elements located on mutually opposed sides of said rigid barrel.

5. The breech system for a firearm according to claim 4, further comprising one or more cut-outs for the purpose of ejecting the cartridge after firing, located in a longitudinal position along said rigid barrel and said barrel block and further wherein said one or more cut-outs are located in at least one of said two trapezoidal carriages.

6. The breech system for a firearm according to claim 5, further comprising an ejector and two mutually opposed mountings for said ejector wherein said two mutually-opposed mountings for said ejector are integrally machined into the breech.

7. The breech system for a firearm according to claim 5, further comprising a spring guide sleeve wherein said trapezoidal carriages engage the breech in said spring guide sleeve thereby creating a second tensioning element for said breech spring.

8. The breech system for a firearm according to claim 4, further comprising one or more cut-outs for the purpose of ejecting the cartridge after firing, located in a longitudinal position along said rigid barrel and said barrel block, and further wherein said one or more cut-outs are located in both of said two trapezoidal carriages.

* * * * *